US005836760A

United States Patent [19]

Turner et al.

[11] Patent Number: 5,836,760

[45] Date of Patent: Nov. 17, 1998

[54] KILN FURNITURE POST DESIGN

[75] Inventors: Craig A. Turner, Auburn; Anthony J. Kulakusky, Oxford, both of Mass.

[73] Assignee: Saint Gobain/Norton Industrial Ceramics Corporation, Worcester, Mass.

[21] Appl. No.: 637,585

[22] Filed: Apr. 25, 1996

Related U.S. Application Data

[63] Continuation of Ser. No. 343,398, Nov. 22, 1994.

[51] Int. Cl.[6] ..... F27D 5/00

[52] U.S. Cl. ..... 432/253; 432/258

[58] Field of Search ..... 432/239, 240, 432/241, 253, 258, 259

[56] References Cited

U.S. PATENT DOCUMENTS

| | | | |
|---|---|---|---|
| 941,044 | 11/1909 | Rivers . | |
| 1,610,111 | 12/1926 | Weaver . | |
| 2,537,145 | 1/1951 | Lovatt et al. | 432/253 |
| 2,543,549 | 1/1951 | Jeppson . | |
| 2,595,599 | 5/1952 | Naillon . | |
| 2,629,917 | 3/1953 | Lovatt | 432/253 |
| 3,847,489 | 11/1974 | Van Riper | 403/110 |
| 3,992,139 | 11/1976 | Lovatt | 432/258 |
| 3,997,289 | 12/1976 | Bowers | 432/241 |
| 4,184,841 | 1/1980 | Robinson et al. | 432/258 |
| 4,315,738 | 2/1982 | Lovatt | 432/258 |
| 4,487,579 | 12/1984 | Irwin | 432/253 |
| 4,504,224 | 3/1985 | Hewitt | 432/258 |
| 4,775,317 | 10/1988 | Schulke et al. | 432/241 |
| 4,836,777 | 6/1989 | Elliot | 432/241 |
| 5,393,226 | 2/1995 | Groom | 432/258 |

FOREIGN PATENT DOCUMENTS

| | | | |
|---|---|---|---|
| 325671 | 8/1989 | European Pat. Off. . | |
| 24 39 254 | 8/1974 | Germany | 432/258 |
| 88 02 708 | 4/1988 | Germany . | |
| 91 14 414 | 1/1992 | Germany . | |
| 121251 | 1/1919 | United Kingdom . | |
| 989083 | 4/1965 | United Kingdom . | |
| 2164734 | 3/1986 | United Kingdom . | |

OTHER PUBLICATIONS

Lo Mass Kiln Furniture Systems Brochure, Norton Company.

*Primary Examiner*—Teresa J. Walberg
*Assistant Examiner*—Gregory A. Wilson
*Attorney, Agent, or Firm*—Thomas M. DiMauro

[57] ABSTRACT

There is provided an improved kiln furniture assembly:

wherein the improvement comprises vertical posts comprising:

i) a vertically disposed channel, and ii) a spacer block (13*a*) vertically separating the upper and lower horizontal beams which extend from the same post, wherein at least a portion of the spacer block or the horizontal beam is positioned within the vertically disposed channel.

7 Claims, 7 Drawing Sheets

KILN FURNITURE POST DESIGN

This application is a continuation of copending application Ser. No. 08/343,398 filed on Nov. 22, 1994.

BACKGROUND OF THE INVENTION

In high volume production of ceramic pieces, the manufacturing line is often designed for continuous production. In continuous production lines, kiln cars containing unfired ceramic pieces are led to a high temperature kiln. When the pieces are exposed to the high temperatures of the kiln, they sinter to their desired structure.

Because the kiln operation is an energy-intensive operation, it is important to pack a kiln car with as many ceramic pieces as possible to maximize efficiency. However, if packing is so tight that the pieces touch each other during firing, the pieces will often fuse together. Therefore, the packing pattern should also insure the pieces do not touch each other. Each of these objectives is furthered by equipping the kiln car with a support structure, termed "kiln furniture", into which the ceramic pieces can be suitably placed in a tight yet controlled pattern.

In constructing one typical kiln furniture design (as set forth in FIG. 1), vertical posts 1 are set into the base of the kiln car 5. Each of these posts 1 has transverse holes (not shown) running horizontally at identical, predetermined intervals. Horizontal beams 7 are slid through the holes. Two parallel beams 7 at the same height form a support plane for stringer 8. The parallel stringers 8 in turn form support planes for batts 9. The ceramic pieces are loaded onto the batt in the direction signified by A (i.e., between posts 1*a* and 1*b*). FIG. 2 represents another representation of the above-discussed prior art design wherein some of the batts are removed, an additional central stringer is used, and the peripheral stringers are inboard of the posts. FIG. 3 is another prior art design wherein the positions of the batts and the stringers are rotated about 90 degrees.

Although the above-described support structure prevents contact between the ceramic pieces and packs relatively efficiently, there is a continual need to improve the efficiency of its design. For example, the design shown in FIG. 1 is efficient only when the ceramic pieces are essentially the same height as the space defined between two intervals. However, when smaller pieces are placed in the structure, a head space is formed between the top of the piece and the next interval. This head space represents lost production.

In order to minimize this inefficiency, the art has sought to modify this design. In one modification, the posts are fitted with many more rows of holes which allow the horizontal beams to be set at selected heights according to the height of the pieces to be fired. This flexibility in row height allows for head space minimization. However, it was found that, in some applications, this design could not survive repeated firings.

Accordingly, there is a need for the development of a superior kiln furniture design which both minimizes head space and can survive repeated firings.

SUMMARY OF THE INVENTION

In accordance with a first embodiment of the present invention, there is provided a kiln furniture assembly comprising:

a) a pair of vertical posts, b) a plurality of short horizontal beams extending from each of said posts at identical intervals and in the same direction, the upper surfaces of the pair of beams at a given interval defining a horizontal surface, and c) a stringer seated upon each of the horizontal surfaces, wherein each beam is supported only by the one post from which it extends.

In a second embodiment of the present invention, there is provided a kiln furniture assembly comprising:

a) a kiln car horizontal surface, b) four vertical posts each having a first end fixed in the kiln car horizontal surface, said posts spaced so that the first ends of the posts define a rectangle in the kiln car surface, c) four horizontal beams, one extending from each of said posts at the same height and in the same direction, the upper surfaces of the beams defining a horizontal surface, d) two stringers, each seated upon two of the parallel but not coaxial beams, said stringers being in parallel horizontal relation, e) a batt having a length of at least about 30 inches seated upon the two stringers, wherein the batt is not supported by any other stringers.

In a third embodiment of the present invention, there is provided a process comprising:

a) forming a kiln furniture assembly comprising:

i) a kiln car horizontal surface, ii) four vertical posts each having a first end fixed in the kiln car horizontal surface, said posts spaced so that the first ends of the posts define a rectangle in the kiln car surface, iii) four horizontal beams, one extending from each of said posts at the same height and in the same direction, the upper surfaces of the beams, defining a horizontal surface in-board of the posts, iv) two stringers, each seated upon two of the parallel but not coaxial beams, said stringers being in parallel horizontal relation, b) loading a rectangular batt upon the two stringers, the batt having ceramic pieces laid thereon, wherein the loading proceeds below the height of the posts, c) firing the pieces, and d) removing the batt having fired ceramic pieces laid thereon from the assembly, wherein the removal proceeds below the height of the posts.

In a fourth embodiment of the present invention, there is provided a kiln furniture assembly comprising a vertical post comprising:

i) a pair of vertical legs defining a vertical void therein, and ii) an intermediate piece positioned within the void.

DETAILED DESCRIPTION OF THE INVENTION

Figure 1:
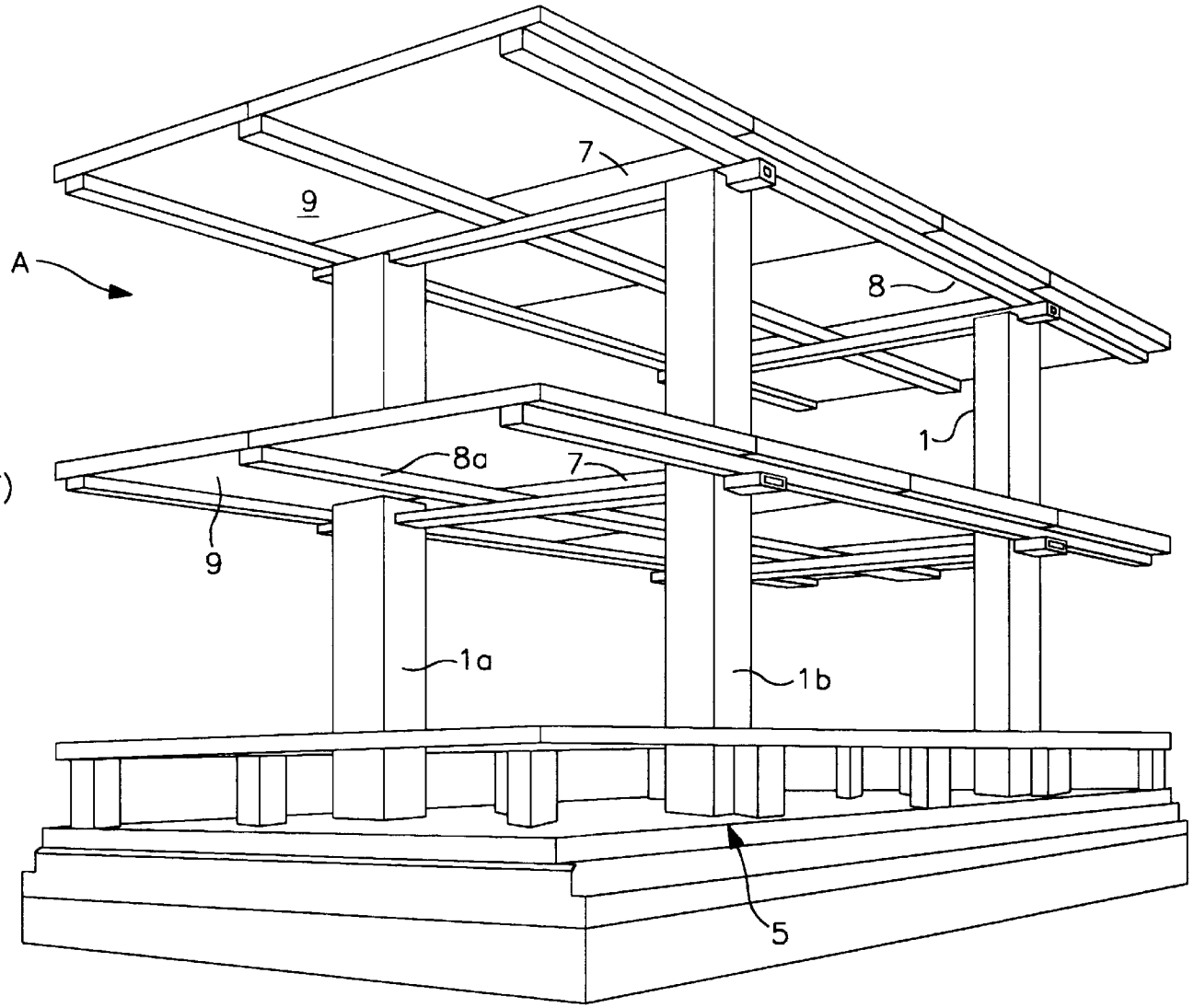
FIG. 1 (PRIOR ART)
FIGS. 1–3 are drawings of conventional prior art designs.
Figure 2:
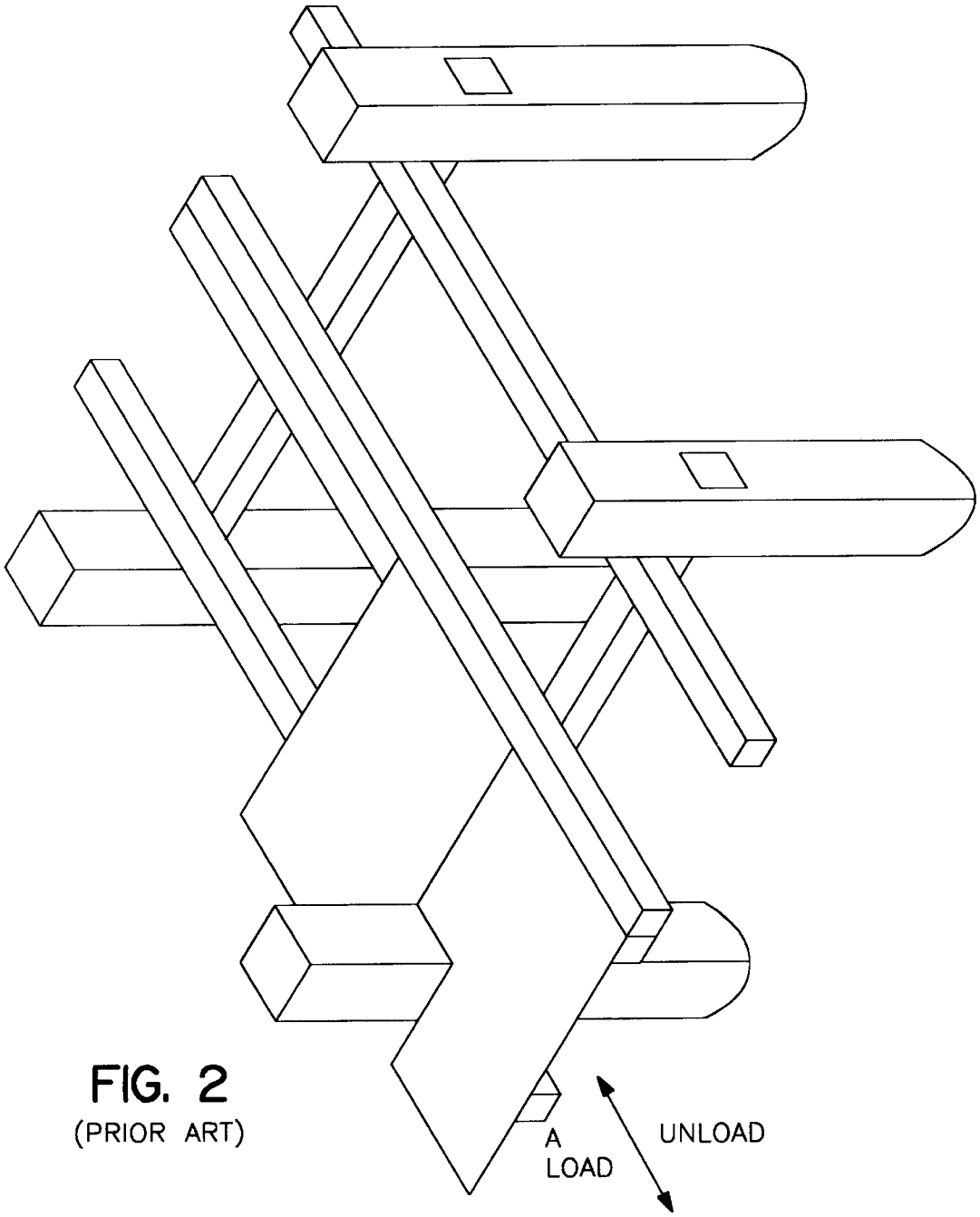
FIG. 2 (PRIOR ART)
Figure 3:
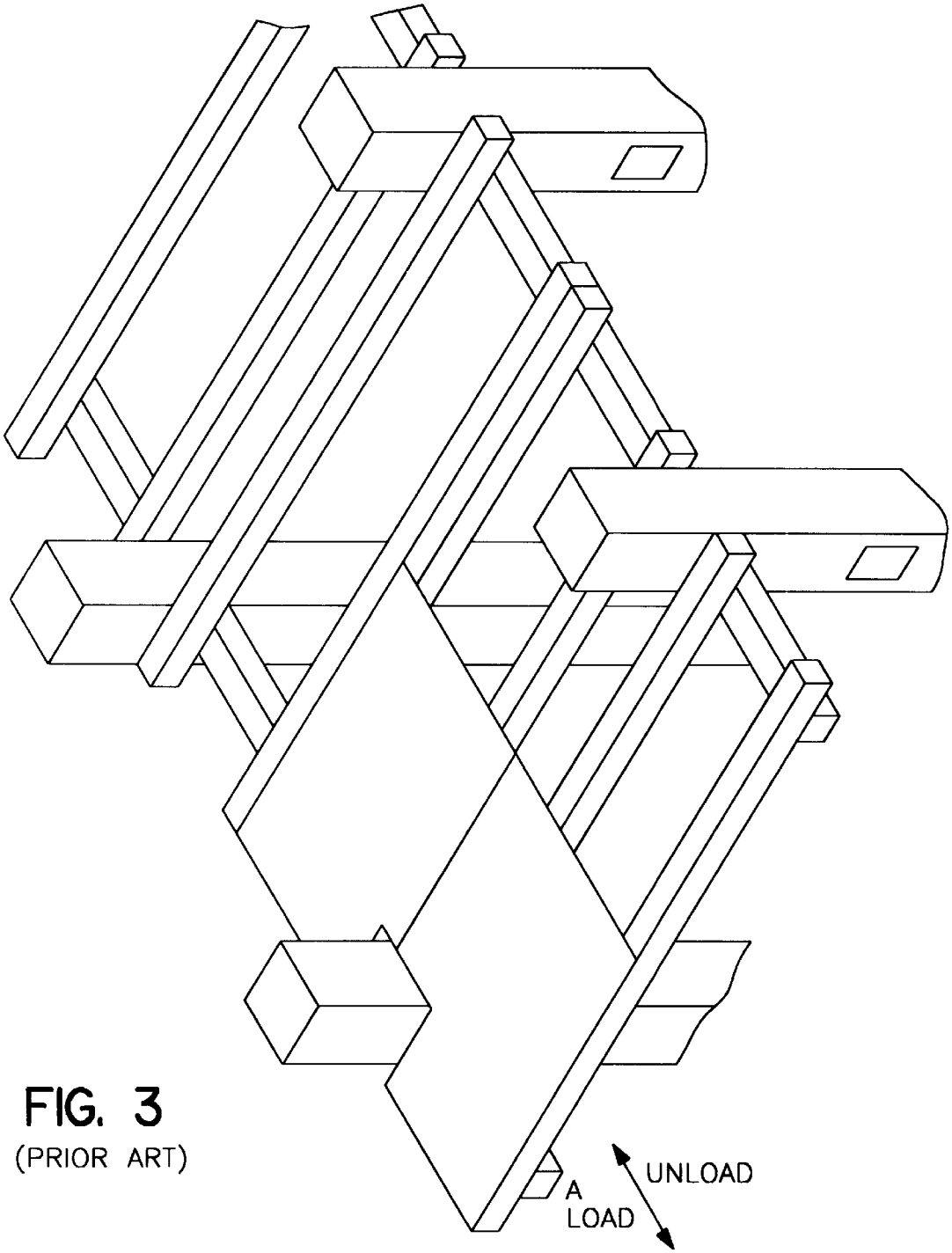
FIG. 3 (PRIOR ART)
Figure 4:
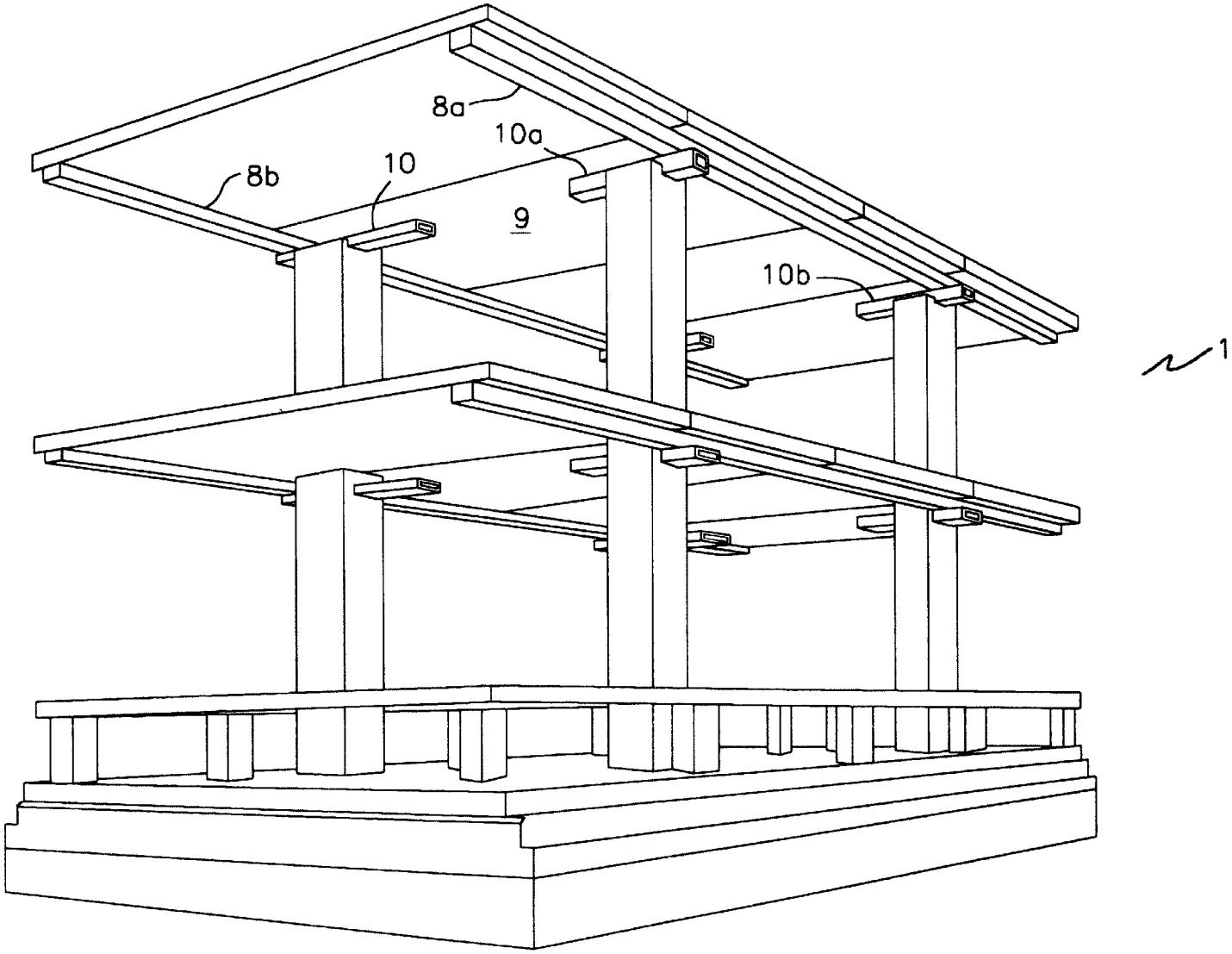
FIGS. 4–5 are drawings of the first embodiment of the present invention.

The first embodiment of the present invention uses a shortened horizontal beam supported by a single post in order to increase the height available between each batt. It has been observed that when ceramic pieces are loaded into conventional kiln furniture designed in accordance with FIG. 1, both beam 7 and stringer 8 present themselves in the cross section normal to the loading direction A. These fixtures must be avoided when pieces are loaded in the A direction and so this valuable space is wasted. It is believed the presentation of these surfaces in the loading cross section often reduces the available space for firing by between about 10% and about 30%. Therefore, in the first embodiment of the present invention (as shown in FIG. 4), the conventional design is modified by replacing the long horizontal beam 7 of FIG. 1 with two shorter horizontal beams 10 (which only partially present themselves in the cross section normal to the loading direction), and deleting middle stringer 8. Because this design allows the deletion of middle stringer 8 and reduces loading interference from beam 7, the available height for loading is increased.

Figure 5:
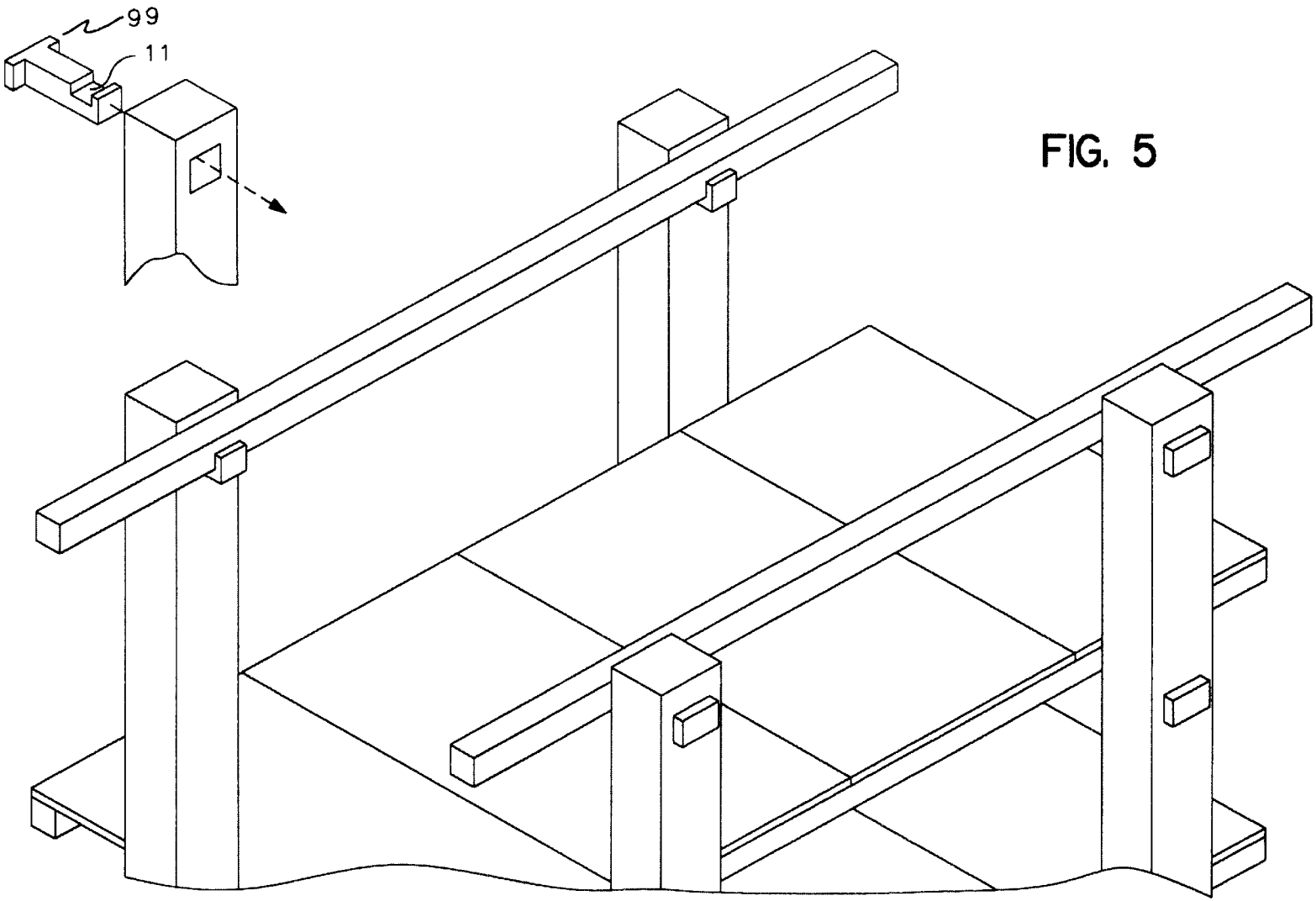

FIG. 4 discloses a typical design for the first embodiment of the present invention. In FIG. 4, four vertical posts 1 are set in the kiln car base. The vertical posts 1 are spaced so that they define the corners of a rectangle when viewed from above. Each post contains transverse holes extending therethrough at identical vertical intervals and in the same direction. Through these holes are slid short horizontal beams 10. Since the beams 10 are shorter than conventional beams 7, they do not reach any other posts. When the beams 10 are slid in place, the upper surfaces of a pair of beams from posts aligned normal to the A direction at a given interval (i.e., beams 10*a* and 10*b*) define a horizontal surface. As shown in FIG. 5, this horizontal surface often contains a transverse groove 11 for accurate and safe placement of the stringer inboard of the post. When stringers 8*a* and 8*b* seat upon the beams 10, a second horizontal surface is defined. Upon this second horizontal surface is seated a batt 9. In preferred embodiments, the short beam extends past the vertical post only to just past the interior face of the stringer (see, for example, FIG. 5). In FIG. 5, the short beam is prevented from moving inward by its nail head 99 and is prevented from moving outward by the stringer of the transverse groove.

In the second embodiment of the present invention, there is provided a long (i.e., longer than about 30 inches) batt 9 which needs only end support. An embodiment of this invention is shown in FIG. 4. It is believed that all conventional batts which were at least about 24 inches in length were thought to be so long as to be susceptible to sagging or breaking upon firing. Therefore, conventional batts either required central stringers underneath them for additional central support or were designed in smaller dimensions. For example, in FIG. 1, conventional batts 9 extend only to the central stringer. Accordingly, there was no expectation that merely peripherally supported long batts would not break or sag. However, it was unexpectedly found that batts approximately 36"×18"×5/16" (made from a recrystallized silicon carbide termed CRYSTAR) did not sag more than 0.001 inches when subjected to 30 firings at 1400° C. and a load of at least about 150 pounds. This finding eliminates the need for a central stringer and increases available firing space by allowing the use of the short horizontal beams disclosed above.

In the third embodiment of the present invention, there is provided mechanically assisted and/or robotic handling of the ceramic-loaded batts. Conventional loading and unloading typically required manual placement and removal of ware from the batt. However, it has been observed by the present inventors that the space defined between the top of horizontal beam 7 and the bottom of batt 9 in the conventional assembly shown in FIG. 1 can be exploited to allow a flat, spatula type tool to both load and remove the loaded batts. Since batt 9 and central stringer 8 displace useable setting height, the above-described handling is expected to especially facilitate the placement and removal of the loaded batts of the first embodiment as shown in FIG. 4.

Figure 6:
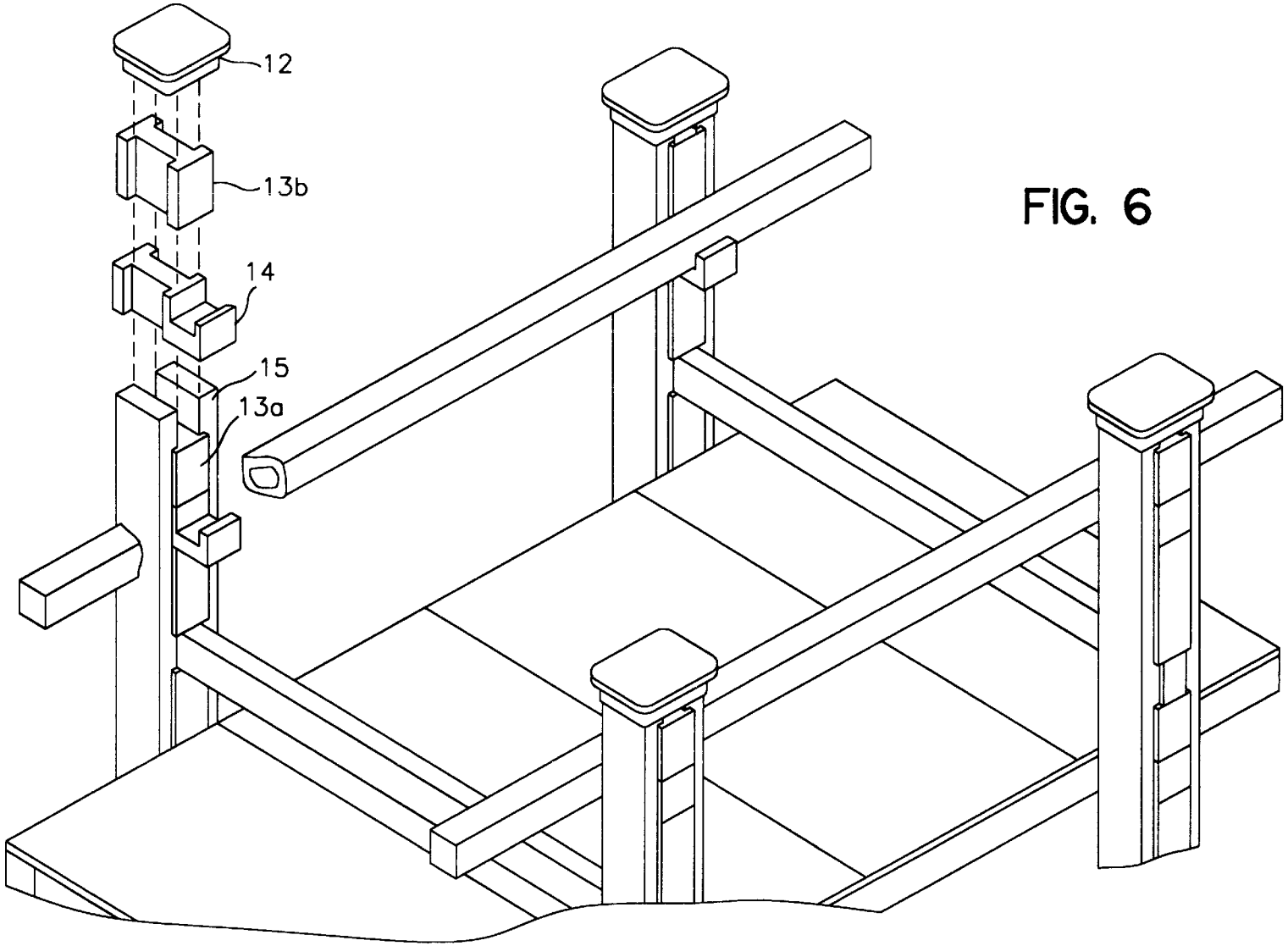
FIGS. 6–7 are drawings of the fourth embodiment of the present invention.

In the fourth embodiment of the present invention, a split-post design is disclosed. Although the kiln furniture design as shown in FIG. 4 improves the space available for firing, it does not allow the artisan to adjust the height of each row of beams after the vertical posts are fixed. As shown in FIG. 6, the split-post design solves this problem by splitting the conventional vertical post along its long axis (resulting in two thinner posts 15), sliding a first intermediate piece 13*a* between the two vertical posts 15, laying horizontal beam 14 onto top of the first intermediate piece 13*a*, sliding a second intermediate piece 13*b* on top of the horizontal beam 14, and so on, and finally containing the split post with cap 12. This design allows the artisan to tailor the height at which horizontal beams are placed in a particular production run, thereby minimizing head space and improving productivity, but without sacrificing post integrity.

Figure 7:
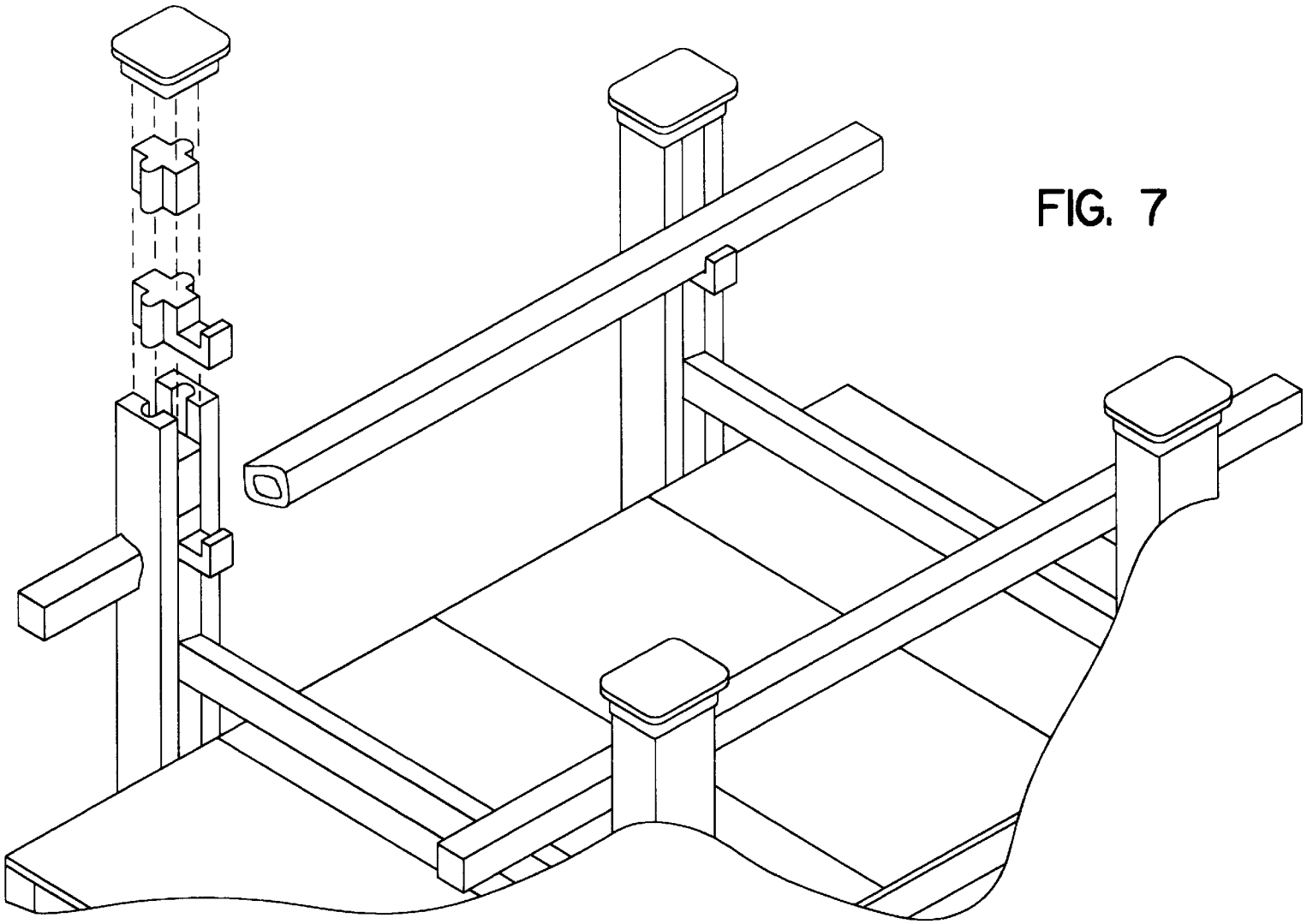

It is also contemplated that the H-blocks and posts can be modified to the designs presented in FIG. 7 and still achieve their goal of inter-firing flexibility.

The vertical posts of the present invention can be made of any refractory material typically used for kiln furniture posts, including carbides such as silicon carbide, or cordierite. Preferably, the posts are made by either slip casting or extruding either nitride-bonded silicon carbide or recrystallized silicon carbide in either one or two pieces. More preferably, ADVANCER or CRYSTAR, each of which is available from the Norton Company of Worcester, Mass., is used. The posts are typically fixed in the kiln car base by a curable castable. Typically, the post has a cross-section of about 5"×5" and a height of at least about 96".

The horizontal beams of the present invention can be made of any refractory material typically used for kiln furniture beams, including carbides such as silicon carbide. Preferably, the posts are made by either slip casting or extruding either nitride-bonded silicon carbide, siliconized silicon carbide or recrystallized silicon carbide in either one or two pieces. More preferably, ADVANCER or CRYSTAR, each of which is available from the Norton Company of Worcester, Mass., is used. When used in conjunction with 5"×5"×96" posts, short beams are typically 2"×2"×8".

The stringers of the present invention are typically made from the same material selected for the horizontal beams. When used in conjunction with 5"×5"×96" posts, stringers are typically 1.5"×1.5"×72".

The batts of the present invention can be made of any refractory material typically used for kiln furniture batts, including carbides such as silicon carbide. Preferably, the batts are made of CRYSTAR, made by the Norton Company of Worcester, Mass.

The present invention can be used in any number of kiln furniture applications, including sanitary ware, high and low voltage porcelain, grinding wheels, automotive components, art ware and dinner ware.

I claim:

1. A kiln furniture assembly comprising:

a) a kiln car horizontal surface, b) four vertical posts each having a first end fixed in the kiln car horizontal surface, said posts spaced so that the first ends of the posts define a rectangle in the kiln car surface, c) four upper horizontal beams, one extending from each of said posts at the same upper height and in the same direction, the upper surfaces thereof defining an upper horizontal surface, d) four lower horizontal beams, one extending from each of said posts at the same lower height and in the same direction, the upper surfaces thereof defining a lower horizontal surface, e) two upper stringers, each seated upon two of the parallel but not coaxial upper beams, said upper stringers being in parallel horizontal relation, f) two lower stringers, each seated upon two of the parallel but not coaxial lower beams, said lower stringers being in parallel horizontal relation, g) upper and lower batts, each batt having two ends, wherein each end of each batt is supported by a single stringer, wherein the improvement comprises each vertical post comprises:

i) a vertically disposed channel, and ii) a spacer block contacting and vertically separating the upper and lower horizontal beams which extend from the same cost, wherein at least a portion of at least one of the spacer block and the horizontal beam above the spacer block is positioned within the vertically disposed channel.

2. The assembly of claim 1 wherein at least a portion of each of the spacer block and the horizontal beam above the spacer block is positioned within the vertically disposed channel member.

3. The assembly of claim 2 wherein each vertical post comprises a pair of spaced, parallel vertical legs having upper ends and a cap connecting the upper end of each leg, and wherein at least a portion of the spacer block is disposed between the legs.

4. The assembly of claim 3 wherein the spacer block is connected to each vertical leg by a vertically disposed male/female connection.

5. The assembly of claim 2 wherein the spacer block and the vertical legs are fixed by at least one vertically disposed male/female connection.

6. The assembly of claim 3 wherein each vertical post is made of a material selected from the group consisting of nitride bonded silicon carbide and recrystallized silicon carbide.

7. The assembly of claim 3 wherein each vertical posts is made of a material selected from the group consisting of carbides and cordierite.

* * * * *